US006889637B2

(12) United States Patent
Rosskamp

(10) Patent No.: US 6,889,637 B2
(45) Date of Patent: May 10, 2005

(54) TWO-CYCLE ENGINE WITH FORWARD SCAVENGING AIR POSITIONING AND SINGLE-FLOW CARBURETOR

(75) Inventor: Heiko Rosskamp, Adelberg (DE)

(73) Assignee: Andreas Stihl AG & Co KG (DE)

( * ) Notice: Subject to any disclaimer, the term of this patent is extended or adjusted under 35 U.S.C. 154(b) by 0 days.

(21) Appl. No.: 10/305,616

(22) Filed: Nov. 26, 2002

(65) Prior Publication Data

US 2003/0106508 A1 Jun. 12, 2003

(30) Foreign Application Priority Data

Dec. 10, 2001 (DE) ..... 101 60 539

(51) Int. Cl.[7] ..... F02B 33/04
(52) U.S. Cl. ..... 123/73 PP; 261/23.3
(58) Field of Search ..... 123/73 PP, 73 A, 123/73 R, 73 B; 261/23.1, 23.3

(56) References Cited

U.S. PATENT DOCUMENTS

| | | | |
|---|---|---|---|
| 4,889,215 A | 12/1989 | Ohkanda | |
| 5,483,931 A | 1/1996 | Stoll et al. | |
| 5,845,757 A | 12/1998 | Csonka | |
| 6,101,991 A | 8/2000 | Glover | |
| 6,152,093 A | 11/2000 | Sawada et al. | |
| 6,298,811 B1 | 10/2001 | Sawada et al. | |
| 6,571,756 B1 * | 6/2003 | Rosskamp et al. | 123/73 PP |
| 6,578,270 B2 | 6/2003 | Hiratsuna et al. | |
| 6,634,326 B2 * | 10/2003 | Radel et al. | 123/73 PP |

FOREIGN PATENT DOCUMENTS

| | | |
|---|---|---|
| DE | 26 50 834 | 6/1977 |
| DE | 37 22 424 | 1/1988 |
| DE | 199 00 445 | 7/2000 |

* cited by examiner

*Primary Examiner*—Tony M. Argenbright
*Assistant Examiner*—Hyder Ali
(74) *Attorney, Agent, or Firm*—Robert W. Becker & Associates; Robert W. Becker

(57) ABSTRACT

A two-cycle engine having forward scavenging is provided. Mixture drawn into the crankcase via a butterfly valve carburetor is conveyed into a combustion chamber via transfer channels in the cylinder. An air duct is connected via a controllable connection with a transfer channel to supply essentially fuel-free air thereto during a load state of the engine. To convey a fuel quantity adapted to drawn-in air during idling and partial load, yet during full throttle to achieve separated supply of air and mixture, a dividing wall extends in the direction of flow of air in the carburetor intake duct. In the pivot region of the butterfly valve, a connecting aperture in the dividing wall is closed in full throttle by a completely open butterfly valve. During idling and partial load the connecting aperture is open so that a uniform pressure can form in the intake duct in conformity with drawn-in air.

20 Claims, 3 Drawing Sheets

Fig. 4
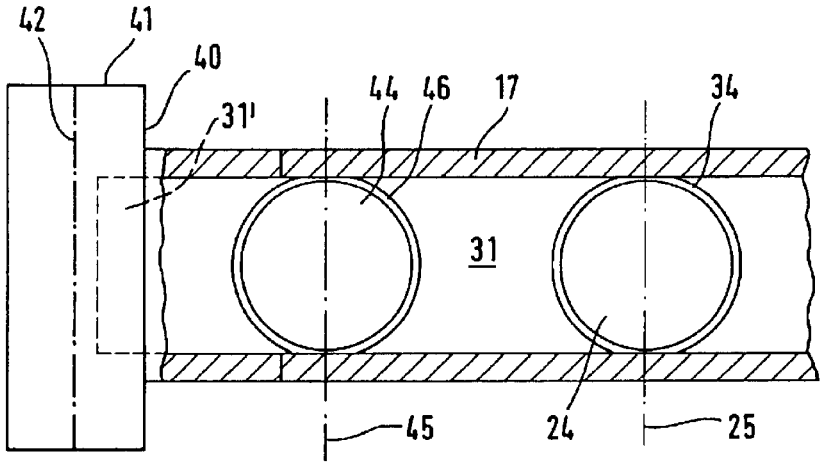
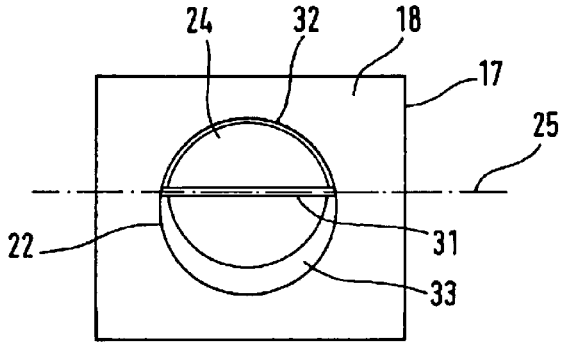
Fig. 5

TWO-CYCLE ENGINE WITH FORWARD SCAVENGING AIR POSITIONING AND SINGLE-FLOW CARBURETOR

BACKGROUND OF THE INVENTION

The present invention relates to a two-cycle engine, especially as a drive engine in a portable, manually-guided tool or implement such as a power chain saw, a brush cutter, a trimmer, a cut-off machine, etc.

A two-cycle engine of this type is known from DE 199 00 445 A1. A combustion chamber formed in the cylinder is connected to the crankcase via transfer passages, the mixture required for combustion being conveyed to the crankcase. In order to ensure that as-little uncombusted fuel as possible is lost through the exhaust or outlet during the scavenging of the combustion chamber, the transfer passages close to the exhaust are connected to an air duct and fuel-free air is drawn in through the transfer passages during the intake stroke. The air is then held at the front of the transfer passages and enters first the next time the mixture transfers into the combustion chamber. The mixture flowing out of the crankcase follows some time later and the scavenging losses flowing out of the exhaust during the scavenging of the combustion chamber come largely from the forward positioned scavenging air.

In practice, a number of problems occur during the metering of the fuel required to operate the internal combustion engine by a carburetor. For example, at idle it is necessary to guarantee that the air duct is fully closed in order to prevent the idle mixture becoming too lean in an uncontrolled manner in the combustion chamber as a result of the air flowing into it. During acceleration, too, the opening of the air duct renders the mixture too lean as a result of which the speed of the internal combustion engine increases only reluctantly to the desired level.

On the other hand, it is important to guarantee that the air duct remains as free as possible from fuel at full throttle in order that the significant reduction in exhaust gas emissions which the forward positioned scavenging air is designed to achieve can be obtained.

The invention is based on the object of designing a two-cycle engine of the aforementioned type in such a manner that it is possible to reliably prevent the mixture in the combustion chamber from becoming too lean at idle and part throttle while retaining the advantageous effects of the supply of fuel-free air with which to scavenge the combustion chamber at full throttle.

BRIEF DESCRIPTION OF THE DRAWINGS

This object, and other objects and advantages of the present invention, will appear more clearly from the following specification in conjunction with the accompanying schematic drawings, in which:

FIG. 4 a schematic sectional view through a carburetor with a throttle valve and a choke valve.

FIG. 5 a schematic view of the front face of a carburetor with an eccentrically positioned butterfly valve shaft.

SUMMARY OF THE INVENTION

A dividing wall in the intake duct of the carburetor divides the venturi along its longitudinal center line into an intake duct section and an air duct. Here the dividing wall is essentially provided along the entire length of the intake duct from one front face of the carburetor body to its other front face in such a manner that even fuel precipitating due to return pulsation upstream of the butterfly or throttle valve is unable to simply pass into the air duct. A connecting aperture is formed in the dividing wall in the pivot region of the throttle valve. At full throttle the throttle valve closes the connecting aperture in the dividing wall in such a manner that the dividing wall, which extends as far as the upstream front face, opposes any transfer of fuel upstream of the throttle valve. The dividing wall preferably extends as far as the base of an air filter fitted upstream of the carburetor, expediently into the air filter housing and in particular as far as the filter element itself. The extension of the dividing wall upstream of the throttle valve into the filter housing achieves a functional division of air duct and mixture duct on the intake side.

The design disclosed in the invention ensures that the pressure prevailing in the venturi at idle and part throttle corresponds to the joint pressure in the air duct and the mixture duct. The volume of fuel conveyed into the venturi in accordance with this joint underpressure is thus proportional to the volume of air conveyed, irrespective of whether it is conveyed to the combustion chamber via the mixture duct or the air duct. This prevents the mixture from becoming too lean at both idle and part throttle.

Similarly, if a choke valve is provided this arrangement guarantees that the underpressure prevailing due to the adjustment of the choke is the same throughout the entire system in such a manner that under choke conditions, too, a volume of fuel adapted to the volume of air drawn in is conveyed and mixed with the air.

In order to achieve a dry, i.e. largely fuel-free, air duct at full throttle, the aperture edge of the connecting aperture and the edge of the valve overlap. Here the overlapping aperture edge can be designed as a seat for the edge of the valve and the aperture edge can also have a seal.

DESCRIPTION OF PREFERRED EMBODIMENTS

Figure 1:
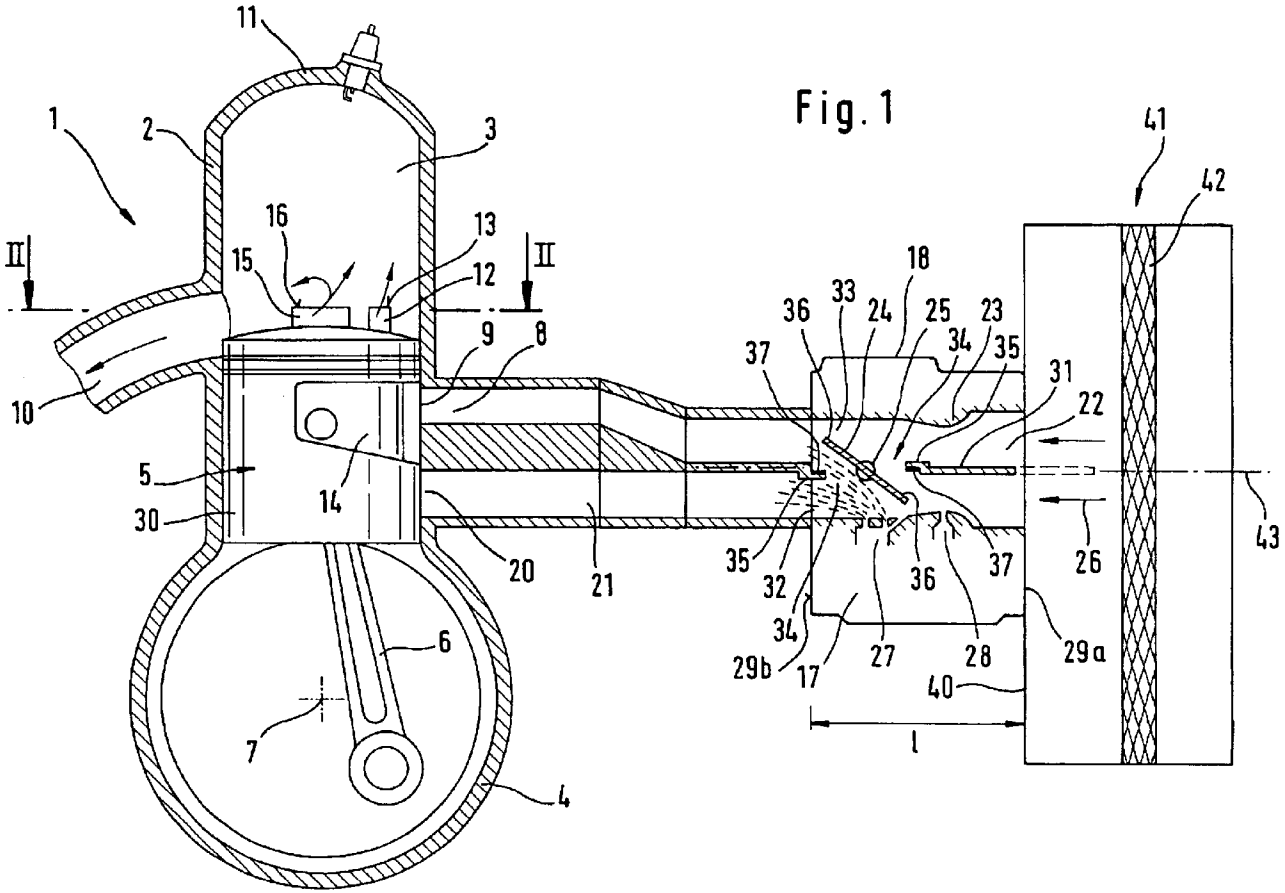
FIG. 1 is a schematic view of a two-cycle engine with port-controlled forward scavenging air positioning and a single-flow carburetor.

The two-cycle engine 1 illustrated schematically in FIG. 1 is used as a small-volume drive engine preferably in manually operated, portable tools such as, for example, chain saws, brush cutters, parting-off grinders, etc. The displacement of an internal combustion engine of this type lies within a range of 18 $cm^3$ and 500 $cm^3$.

The two-cycle engine 1 has a cylinder 2 in which is provided a combustion chamber 3 which is delimited by a reciprocating piston 5. Via a connecting rod 6, the piston 5 drives a crankshaft 4 which is mounted in a crankcase 4 in such a manner that it can rotate.

An inlet 20, which in the illustrated embodiment is controlled by the piston skirt 30 opens into the crankcase 4. In the embodiment shown, the inlet 20 is therefore opened and closed dependent upon the stroke position of the piston 5. It can be useful to provide a membrane or diaphragm control system instead of the piston port control system illustrated. The inlet 20 then opens into the crankcase 4 outside the piston stroke area, it being necessary to position a membrane valve which opens in the direction of the crankcase 4 in the inlet 20. The opening of the inlet 20 is then controlled by underpressure.

Figure 2:
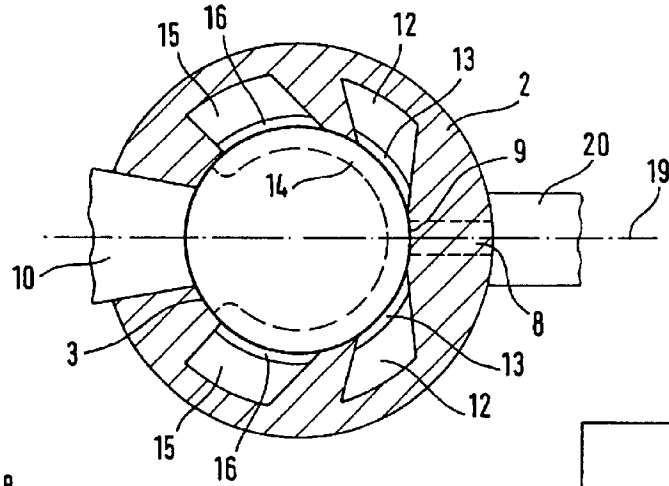
FIG. 2 a schematic section along the line marked II—II in FIG. 1.

The crankcase 4 is connected to the combustion chamber 3 via transfer passages 12, 15, these transfer passages—see FIG. 2—being designed as straight or handle-shaped passages in the side wall of the cylinder. In the version illustrated, two transfer passages 12 and two transfer passages 15 are provided, one of each on either side of a plane of symmetry 19. The transfer passages 15 are located close to an outlet or exhaust 10 which conveys exhaust gases out of the combustion chamber 3 and are also referred to as exhaust transfer passages 15. The transfer passages 12 are positioned some distance from the exhaust 10 and are referred to as exhaust-distant transfer passages 12. As illustrated in the section shown in FIG. 2, the plane of symmetry 19 divides the cylinder 2 into symmetrical halves and runs roughly centrally through the exhaust 10 and the inlet 20.

The end of each transfer passage 12, 15 facing the cylinder head 11 opens into the combustion chamber 3 via a transfer window or port 13, 16. The transfer ports 13, 16 are controlled by the piston 5 as it reciprocates, the transfer ports 13, 16 being open in a lower piston position close to bottom dead center (BDC) illustrated in FIG. 1 and being closed in an upper piston position between BDC and top dead center (TDC). The ends of the transfer passages 12, 15 facing the crankcase 4 are open in both the lower and the upper piston positions.

Furthermore, the transfer passages 12, 15 can also be connected to an air duct 8 which opens into an air port 9 in the wall of the cylinder 2. A connecting port 14 is formed in the piston skirt 30 at the level of the air port 9 and, as illustrated in FIG. 2, extends from the air port 9 opposite the exhaust 10 in both directions around the circumference of the piston covering a circumferential angle of some 120° such that in the corresponding piston stroke position the transfer ports 13, 15 communicate with the connecting port 14, the connecting port 14 being designed such that it also connects with the air port 9 of the air duct 8 in this piston stroke position. Thus, when the piston 5 rises towards TDC, a connection is made between the air duct 8 and the transfer ports 13, 15 and due to the underpressure prevailing in the crankcase 4 at the time, medium is drawn in from the air duct 8 through the transfer passages 12, 15.

The air duct 8 and an inlet duct 21 leading to the inlet 20 are connected separately to a mixture formation device which is a carburetor 17 in the embodiment shown. The carburetor 17 is expediently a diaphragm carburetor of the type predominantly used in drive engines in portable, manually operated tools. In the carburetor body 18 is a common intake duct 22 with a venturi 23. Also positioned in the intake duct 22 is a throttle or butterfly valve 24 which is mounted on a throttle shaft 25 in the carburetor body 18 in such a manner that it is able to rotate. The common intake duct 22 is divided by means of a partition or dividing wall 31 which extends along the longitudinal center line 43 in the direction of the air flow 26. The fuel feeders, in the embodiment illustrated idle jets 27 and a main fuel jet 28, are located on one side of the dividing wall 31 which extends essentially from one front face 29*a* to the other front face 29*b* of the carburetor body 18 along the entire length l of the intake duct 22. Here the part of the duct which contains the fuel feeders 27, 28 forms an intake duct section 32 which is connected to the inlet duct 21. The other part of the duct forms an air duct 33 which is connected to the air duct 8 of the air port 9. In the area of rotation of the throttle valve 24 is a connecting aperture 34 in the dividing wall 31 which forms a connection between the intake duct section 32 and the air duct 33. This connection creates identical pressure conditions on both sides of the dividing wall 31 when the connecting aperture 34 is open. When the connecting aperture 34 is open, the diaphragm carburetor 17 therefore conveys a volume of fuel which is always proportional to the volume of air drawn in via the jets 27, 28.

In the part throttle position illustrated in FIG. 1, the throttle valve is located half open transverse to the longitudinal center line 43 in the intake duct, the axis of rotation of the throttle valve being located exactly in the plane of the dividing wall 31. In this throttle valve position, the connecting aperture 34 is partially open and the fuel drawn in through the fuel jets 27 therefore enters both the intake duct section 32 and the air duct 33 via the open connecting aperture 34. At idle and/or part throttle, both the air duct 8 and the inlet duct 21 therefore convey a fuel/air mixture, it being possible, due to the arrangement of the jets in the intake duct section 32, for the fuel/air mixture conveyed in the inlet duct 21 to be richer than that conveyed in the air duct 8 into which fuel is only allowed to enter via the partially opened connecting aperture 34.

Downstream of the carburetor 17 the intake duct section 32 is connected to the inlet 20 via the inlet duct 21, and the air duct 33 is connected to the air port 9 via the connecting or air duct 8. Downstream of the carburetor 17 the air ducts 8, 33 therefore run separately from the mixture ducts 21, 32.

When the internal combustion engine is in operation, as the piston 5 rises towards TDC the transfer ports 13, 16 and the exhaust 10 are closed. The rising piston 5 opens the inlet 20 and at the same time or a few crank angle degrees later connects the air port 9 to the transfer ports 13, 16 via the connecting port 14. Thus at the same time as the air duct 8 is connected to the transfer passages 12, 15 or slightly earlier, the inlet 20 to the crankcase 4 is opened, allowing the mixture to flow into the crankcase 4. When the air port 9 of the connecting port is connected to the transfer windows 13, 16, a fuel-lean mixture or largely fuel-free air is drawn in and flows down through the transfer ports 13, 16 to the crankcase 4. The transfer passages 12, 15 thus fill with lean mixture or with largely fuel-free air, the transfer passages 15 close to the exhaust preferably being filled with air.

Following ignition, the piston 5 descends to BDC again, the flow connection between the transfer passages 12, 15 and the air duct 8 being interrupted and the inlet 20 being closed. Since the piston 5 is descending, the mixture drawn into the crankcase 4 is compressed and, as the piston-controlled transfer ports 13, 16 are opened, flows into the combustion chamber 3, filling it with fresh mixture for the next compression stroke. Here the fuel-lean or fuel-free air is positioned forward of the rich mixture in the crankcase 4 and scavenging losses flowing out through the open exhaust 10 are therefore largely formed by the fuel-lean mixture and the fuel-free air.

Figure 3:
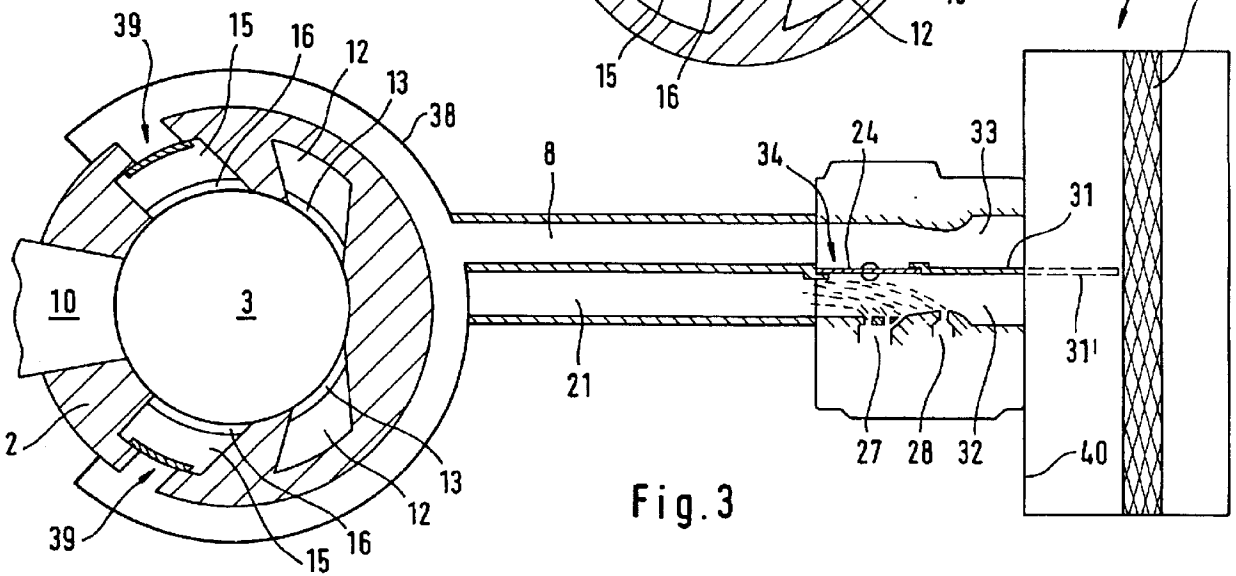
FIG. 3 a schematic view of a section of a membrane-controlled system with forward scavenging air positioning as illustrated in FIG. 2.

At full throttle, the throttle valve 24 is fully open as illustrated in the example of a diaphragm or membrane-controlled forward scavenging air positioning system shown in FIG. 3. When the throttle valve 24 is fully open it lies roughly-parallel to the longitudinal center line 43 such that the air duct 33 and the intake duct section 32 are completely separate from each other since the throttle valve 24 preferably seals the connecting aperture 34. In order to achieve this, the connecting aperture 34 is designed with a slightly smaller throughput section than that of the valve 24 itself. The aperture edge 35 of the connecting aperture 34 and the edge 36 of the throttle valve 24 overlap one another, thereby achieving a sealed fit. Here the aperture edge 35 is expediently designed as a seat for the edge 36 of the valve, the aperture edge 35 expediently bearing a seal 37. The seal is preferably a rubber seal which may be provided in the form of a gasket or a tied-in seal. This guarantees that the air duct 8 is dry, i.e. free of fuel, at full throttle and thus that scavenging losses which occur during the scavenging of the combustion chamber 3 comprise exclusively fuel-free air.

In order to guarantee that the air duct 8, 33 remains free of fuel at full throttle, the dividing wall 31 is designed to extend upstream of the carburetor 17 as far as the base 40 of an air filter 41. If the dividing wall 31' (FIG. 3) is taken into the air filter housing, preferably extended into the area of the filter element 42, it is possible to prevent fuel precipitating in the air filter 41 as a result of air pulsation in the intake train from transferring to the air duct 33.

While in the embodiment illustrated in FIGS. 1 and 2 the connection between the air ducts 8, 33 and the transfer passages is controlled by piston ports, FIG. 3 shows a connection between the air duct 8 and at least the transfer passages 15 close to the exhaust port via a distributor duct 38 and a non-return valve which is designed as a membrane valve 39 in the embodiment. The distributor duct 38 can be designed as an external duct, a hose connection or a duct integrated into the cylinder 2. As the piston 5 rises, underpressure is created in the crankcase 4 and also in the transfer passages 12, 15 due to the fact that these transfer passages 12, 15 are open to the crankcase 4. Due to the pressure difference thus created at the membrane valve 39, the membrane valve 39 opens and fuel-lean mixture/fuel-free air is drawn into the transfer passage 15 close to the exhaust via the membrane valve 39. As the piston 5 descends, the overpressure which builds up in the crankcase 4 closes the membrane valve 39. It can also be useful to connect the transfer passages 12 to the air duct via a non-return valve such as a membrane valve, e.g. via a controlled connection to the distributor duct 38.

In the embodiment illustrated in FIG. 4, a choke valve 44 is provided upstream of the throttle valve 24 and is mounted on a choke shaft 45 in the carburetor 17 or the carburetor body 18 in such a manner that it can rotate. The choke shaft 44 is located in the plane of the dividing wall 31, 31'. The choke valve 44 is associated with a further connecting aperture 46 in the dividing wall 31, whereby when the choke valve 44 is in the open position illustrated in FIG. 4 the further connecting aperture 46 is largely closed by the choke valve 44. Here it is possible to provide sealing measures such as those which have already been described in relation to the throttle valve 24. This design guarantees that when the choke and the partially opened throttle valve 24 are actuated, the higher intake underpressure produced takes effect in both the air duct and the mixture duct, the pressure conditions in the venturi are therefore identical and a volume of fuel proportional to the volume of air drawn in is metered.

It can be expedient to position the dividing wall 31, 31' in the carburetor body 18 eccentrically in relation to the intake duct 22 thereby giving the air duct 33 and the mixture duct 32 different cross sectional areas. In this case, the throttle shaft 25 and a choke shaft 45 continue to be located approximately in the plane of the dividing wall 31, but slightly offset relative to the center of the intake duct 22 as shown in FIG. 5. The ratio A/L between the cross sectional area of the intake duct section 32 and the cross sectional area of the air duct 33 lies roughly within a range of 0.5 to 1.9 and preferably within a range of 0.54 to 1.86. This means that the cross sectional area of the air duct can be between 65% and 35% of the total cross sectional area of the intake duct 22.

I claim:

1. A two-cycle engine having a cylinder in which is formed a combustion chamber that is delimited by a reciprocating piston which, via a connecting rod, drives a crank shaft that is rotatably mounted in a crank case, wherein an inlet opens into said crankcase, wherein said inlet communicates with an intake duct section of a carburetor via which a fuel/air mixture is to be drawn into said crankcase, wherein a cross-sectional area of said intake duct section is variable via a butterfly valve that during idling of said engine is disposed approximately transverse to a longitudinal central axis of said intake duct section and during full throttle is disposed approximately parallel to said longitudinal central axis, wherein at least one transfer channel is formed in said cylinder and connects said crankcase with said combustion chamber, wherein at an end facing a cylinder head of said cylinder, said at least one transfer channel opens into said combustion chamber via a transfer port that is controlled by said piston and that is open in a lower position of said piston and is closed in an upper position of said piston, wherein an end of said at least one transfer channel that faces said crankcase is open in both said upper and lower positions of said piston, wherein an air duct is provided that via a controllable connection is in communication with said at least one transfer channel in a vicinity of said end of the latter that faces said cylinder head in order, during a load state of said engine, to supply essentially fuel-free air to said at least one transfer channel, and wherein an outlet is provided on said cylinder for conveying exhaust gas away from said combustion chamber, said engine further comprising:

a dividing wall that extends in a direction of flow of air through said carburetor and divides an intake duct of said carburetor such that one duct portion, which is provided with fuel supply means, forms said intake duct section, and another duct portion forms said air duct, wherein said dividing wall extends essentially over an entire length of said intake duct from one end face of a housing of said carburetor to another end face thereof, wherein in a pivot region of said butterfly valve said dividing wall is provided with a connecting aperture that in a full throttle state of said engine is essentially closed by a completely open butterfly valve such that in said full throttle state said air duct and said intake duct section are separated from one another.

2. A two-cycle engine according to claim 1, wherein an air filter is disposed upstream of said carburetor, and wherein said dividing wall extends at least to a base of said air filter.

3. A two-cycle engine according to claim 2, wherein said dividing wall extends into a housing of said air filter.

4. A two-cycle engine according to claim 3, wherein said dividing wall extends to a region of a filter element of said air filter.

5. A two-cycle engine according to claim 1, wherein a choke valve is disposed upstream of said butterfly valve, and wherein in the region of said choke valve there is provided in said dividing wall a second connecting aperture that in an open position of said choke valve is essentially completely closed thereby.

6. A two-cycle engine according to claim 5, wherein each respective connecting aperture has a slightly smaller passage cross section than does a surface of a respective one of said valves.

7. A two-cycle engine according to claim 6, wherein an opening edge of a respective connecting aperture overlaps with an edge of the corresponding valve.

8. A two-cycle engine according to claim 7, wherein the overlap opening edge is formed as a sealing seat for said valve edge.

9. A two-cycle engine according to claim 8, wherein said overlapped opening edge is provided with a seal.

10. A two-cycle engine according to claim 9, wherein said seal is a rubber seal.

11. A two-cycle engine according to claim 1, wherein dividing wall divides said intake duct such that a ratio of a cross-sectional area of said intake duct section to a cross-sectional area of said air duct is approximately the range of 0.5 to 1.9.

12. A two-cycle engine according to claim 11, wherein said ratio is in a range of approximately 0.54 to 1.86.

13. A two-cycle engine according to claim 5, wherein a shaft of a respective one of said valves is mounted in said housing of said carburetor such that it is eccentric relative to a cross-section of said intake duct.

14. A two-cycle engine according to claim 1, wherein said air duct is connected to said cylinder head end of said at least one transfer channel via a check valve.

15. A two-cycle engine according to claim 14, wherein said check valve is a reed valve.

16. A two-cycle engine according to claim 1, wherein said air duct is connectable with said transfer port of said at least one transfer channel, via a connecting port provided in said piston, as a function of a stroke position of said piston.

17. A two-cycle engine according to claim 1, wherein said mixture inlet is opened at approximately the same time as a connection of said air duct with said at least one transfer channel.

18. A two-cycle engine according to claim 1, wherein said mixture inlet is opened slightly earlier than a connection of said air duct with said at least one transfer channel.

19. A two-cycle engine having a cylinder-in which is formed a combustion chamber that is delimited by a reciprocating piston which, via a connecting rod, drives a crank shaft that is rotatably mounted in a crank case, wherein an inlet opens into said crankcase, wherein said inlet communicates with an intake duct section of a carburetor via which a fuel/air mixture is to be drawn into said crankcase, wherein a cross-sectional area of said intake duct section is variable via a butterfly valve that during idling of said engine is disposed approximately transverse to a longitudinal central axis of said intake duct section and during full throttle is disposed approximately parallel to said longitudinal central axis, wherein at least one transfer channel is formed in said cylinder and connects said crankcase with said combustion chamber, wherein at an end facing a cylinder head of said cylinder, said at least one transfer channel opens into said combustion chamber via a transfer port that is controlled by said piston and that is open in a lower position of said piston and is closed in an upper position of said piston, wherein an end of said at least one transfer channel that faces said crankcase is open in both said upper and lower positions of said piston, wherein an air duct is provided that via a controllable connection is in communication with said at least one transfer channel in a vicinity of said end of the latter that faces said cylinder head in order, during a load state of said engine, to supply essentially fuel-free air to said at least one transfer channel, and wherein an outlet is provided on said cylinder for conveying exhaust gas away from said combustion chamber, said engine further comprising:

a dividing wall that extends in a direction of flow of air through said carburetor and divides an intake duct of said carburetor such that one duct portion, which is provided with fuel supply means, forms said intake duct section, and another duct portion forms said air duct, wherein said dividing wall extends essentially over an entire length of said intake duct from one end face of a housing of said carburetor to another end face thereof, wherein in a pivot region of said butterfly valve said dividing wall is provided with a connecting aperture that in a full throttle state of said engine is essentially closed by a completely open butterfly valve such that in said full throttle state said air duct and said intake duct section are separated from one another, wherein an air filter is disposed upstream of said carburetor, and wherein said dividing wall extends at least to a base of said air filter.

20. A two-cycle engine having a cylinder in which is formed a combustion chamber that is delimited by a reciprocating piston which, via a connecting rod, drives a crank shaft that is rotatably mounted in a crank case, wherein an inlet opens into said crankcase, wherein said inlet communicates with an intake duct section of a carburetor via which a fuel/air mixture is to be drawn into said crankcase, wherein a cross-sectional area of said intake duct section is variable via a butterfly valve that during idling of said engine is disposed approximately transverse to a longitudinal central axis of said intake duct section and during full throttle is disposed approximately parallel to said longitudinal central axis, wherein at least one transfer channel is formed in said cylinder and connects said crankcase with said combustion chamber, wherein at an end facing a cylinder head of said cylinder, said at least one transfer channel opens into said combustion chamber via a transfer port that is controlled by said piston and that is open in a lower position of said piston and is closed in an upper position of said piston, wherein an end of said at least one transfer channel that faces said crankcase is open in both said upper and lower positions of said piston, wherein an air duct is provided that via a controllable connection is in communication with said at least one transfer channel in a vicinity of said end of the latter that faces said cylinder head in order, during a load state of said engine, to supply essentially fuel-free air to said at least one transfer channel, and wherein an outlet is provided on said cylinder for conveying exhaust gas away from said combustion chamber, said engine further comprising:

a dividing wall that extends in a direction of flow of air through said carburetor and divides an intake duct of said carburetor such that one duct portion, which is provided with fuel supply means, forms said intake duct section, and another duct portion forms said air duct, wherein said dividing wall extends essentially over an entire length of said intake duct from one end face of a housing of said carburetor to another end face thereof, wherein in a pivot region of said butterfly valve said dividing wall is provided with a connecting aperture that in a full throttle state of said engine is essentially closed by a completely open butterfly valve such that in said full throttle state said air duct and said intake duct section are separated from one another, where a choke valve is disposed upstream of said butterfly valve, and wherein in the region of said choke valve there is provided in said dividing wall a second connecting aperture that in an open position of said choke valve is essentially completely closed thereby.

* * * * *

UNITED STATES PATENT AND TRADEMARK OFFICE

CERTIFICATE OF CORRECTION

PATENT NO. : 6,889,637 B2
DATED : May 10, 2005
INVENTOR(S) : Rosskamp

It is certified that error appears in the above-identified patent and that said Letters Patent is hereby corrected as shown below:

Title page,
Item [57], ABSTRACT,
Line 16, should read -- During idling and partial load the connecting aperture is open so that uniform pressure can form in the intake duct in conformity with drawn-in air. --

Signed and Sealed this

Twelfth Day of July, 2005

JON W. DUDAS
*Director of the United States Patent and Trademark Office*